US010689805B2

(12) United States Patent
Ito et al.

(10) Patent No.: US 10,689,805 B2
(45) Date of Patent: Jun. 23, 2020

(54) PRINTER AND CURL STRAIGHTENING METHOD

(71) Applicant: MIMAKI ENGINEERING CO., LTD., Nagano (JP)

(72) Inventors: Shin Ito, Nagano (JP); Tomohiro Takano, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 226 days.

(21) Appl. No.: 15/885,825

(22) Filed: Feb. 1, 2018

(65) Prior Publication Data

US 2018/0230648 A1 Aug. 16, 2018

(30) Foreign Application Priority Data

Feb. 16, 2017 (JP) ..... 2017-027075

(51) Int. Cl.

| | |
|---|---|
| ***D06C 15/00*** | (2006.01) |
| ***D06P 7/00*** | (2006.01) |
| ***D06C 3/06*** | (2006.01) |
| ***B41F 25/00*** | (2006.01) |
| ***B41F 17/38*** | (2006.01) |
| ***B41F 23/00*** | (2006.01) |
| ***D06B 23/02*** | (2006.01) |

(52) U.S. Cl.

CPC ..... *D06P 7/00* (2013.01); *B41F 17/38* (2013.01); *B41F 23/00* (2013.01); *B41F 25/00* (2013.01); *D06B 23/026* (2013.01); *D06C 3/06* (2013.01)

(58) Field of Classification Search

CPC ..... D06C 15/00

USPC ..... 400/611

See application file for complete search history.

(56) References Cited

U.S. PATENT DOCUMENTS

| | | | | |
|---|---|---|---|---|
| 4,224,724 | A * | 9/1980 | Bassani | B65H 23/022 226/20 |
| 5,850,982 | A * | 12/1998 | Roth | B65H 18/08 242/413.5 |
| 6,250,220 | B1 * | 6/2001 | Sainio | B65H 23/0256 101/228 |
| 6,802,110 | B2 * | 10/2004 | Berweger | B65H 23/035 26/71 |
| 6,973,702 | B2 * | 12/2005 | Harashige | B65H 23/0256 26/51 |

(Continued)

FOREIGN PATENT DOCUMENTS

JP 2004-27433 1/2004

*Primary Examiner* — Anthony H Nguyen
(74) *Attorney, Agent, or Firm* — JCIPRNET

(57) ABSTRACT

A curl straightening method applied upon printing on a spread medium in a printing step, the method being provided with a first spreading step of spreading the medium fed out from a medium roll between a feeding step of feeding the medium from the medium roll in which the medium made of a textile fabric and having a predetermined width is wound on a roll core, and the printing step of printing on the medium fed out from the medium roll, and in the first spreading step, spreading of the medium is performed in a state where the medium fed out from the medium roll is stretched on an outer circumference of a first spreader roller rotating about a pivotal axis parallel to a pivotal axis of the medium roll, and the medium has its surface side with a curl stretched on the outer circumference of the first spreader roller.

15 Claims, 8 Drawing Sheets

(56) References Cited

U.S. PATENT DOCUMENTS

2006/0034634 A1* 2/2006 Yu ..... G03G 15/754
399/165

* cited by examiner

PRINTER AND CURL STRAIGHTENING METHOD

CROSS REFERENCE TO RELATED APPLICATIONS

This application claims the priority benefit of Japanese Patent Application No. 2017-027075, filed on Feb. 16, 2017. The entirety of the above-mentioned patent application is hereby incorporated by reference herein and made a part of this specification.

TECHNICAL FIELD

The present disclosure relates to a printer and a curl straightening method.

DESCRIPTION OF THE BACKGROUND ART

A textile fabric medium having a stretching property similar to a knitted fabric often generates a curl at least at one side portion in a width direction, so Japanese Unexamined Patent Publication No. 2004-27433 discloses a method that performs printing after having spread out a width of such type of medium and removed the curl.

Patent literature 1: Japanese Unexamined Patent Publication No. 2004-27433

SUMMARY

However, when printing is attempted on various types of textile fabric media, a curl may not be sufficiently removed in some cases due to a direction and a degree of the curl being different for every medium, and the direction of the curl being different depending on a winding direction of the medium on a medium roll.

Thus, there is a demand to enable printing after having suitably removed a curl generated in a medium having stretching property similar to a knitted fabric.

The present disclosure is a method for straightening a curl of a medium on which printing is performed in a printing step, the method including: a first spreading step of spreading the medium fed out from a medium roll, the first spreading step being performed between a feeding step of feeding the medium from the medium roll, in which the medium made of a textile fabric and having a predetermined width is wound on a roll core, and a printing step of printing on the medium fed out from the medium roll. In the first spreading step, the medium is spread in a state where the medium fed out from the medium roll is stretched on an outer circumference of a first spread roller configured to rotate about a first pivotal axis parallel to a center axis of the medium roll, and the medium has a curled surface side stretched on the outer circumference of the first spread roller.

In the present disclosure, the first spreading step of spreading the medium fed out from the medium roll by winding (stretching) it on the outer circumference of the first spreader roller is provided between the feeding step and the printing step, and in the first spreading step, the medium is configured to have its curled surface side wound on the outer circumference of the first spreader roller.

Thus, printing can be performed after having suitably removed the curl generated in the medium having stretching property similar to a knitted fabric.

DETAILED DESCRIPTION OF EMBODIMENTS

Hereinbelow, an embodiment of the present disclosure will be explained by exemplifying a case of a printer 1, which performs printing on a medium made of a textile fabric having stretching property similar to a knitted fabric.

Figure 1:
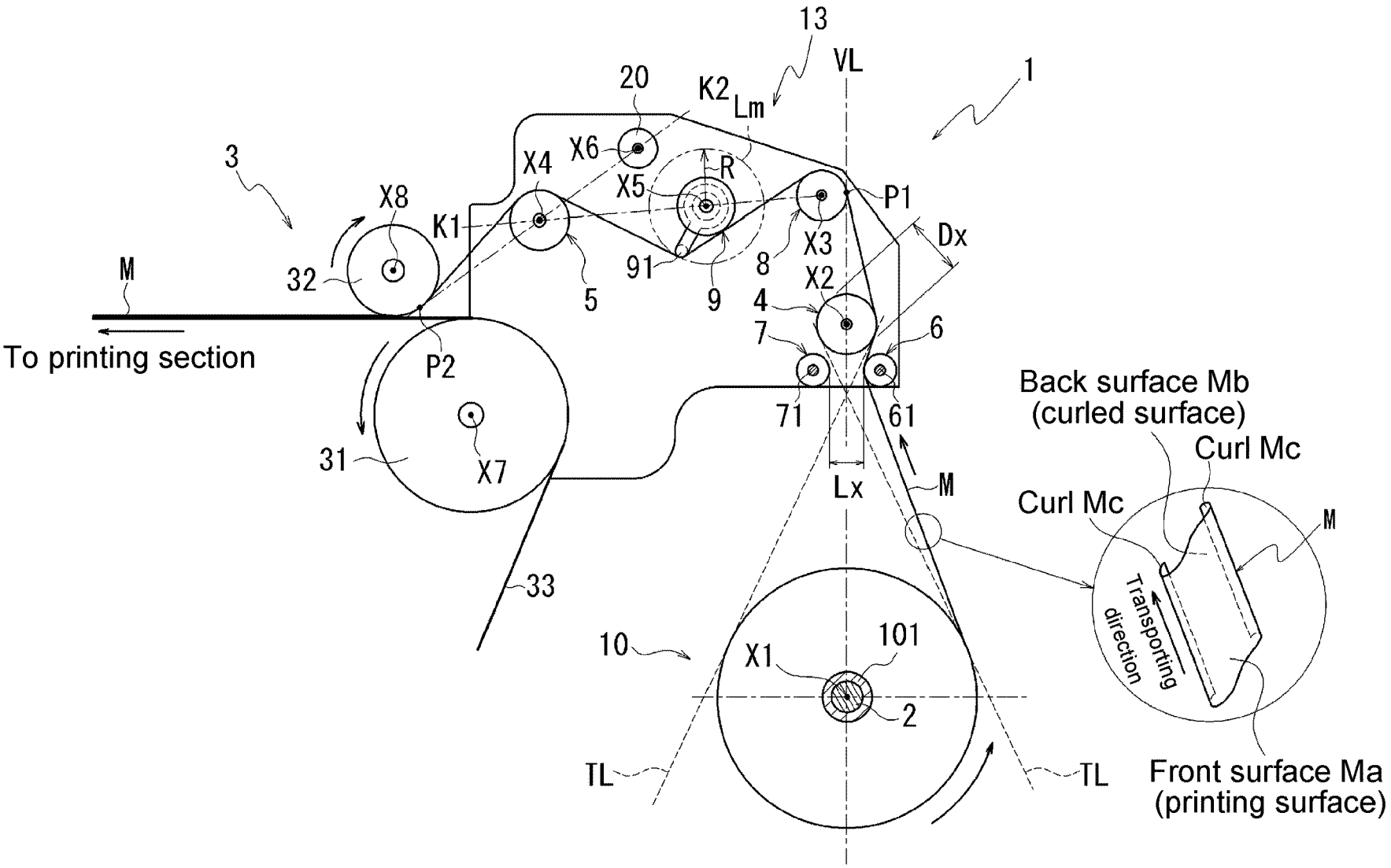
FIG. 1 is a diagram explaining a primary part on a transport section side in a printer according to an embodiment.

FIG. 1 is a diagram explaining a primary configuration on a transport section 13 side of a medium M in the printer 1.

Printer

As illustrated in FIG. 1, the printer 1 is configured to perform printing on the medium M fed out from a medium roll 10, and a transport section 13 of the medium M fed out from the medium roll 10 is provided between a support shaft 2 for rotatably supporting the medium roll 10 and a transport mechanism section 3 for transporting the medium M toward a printing section that is not illustrated.

Here, the medium M in the embodiment is a medium made of a textile fabric woven by a material having stretching property similar to a knitted fabric (hereinbelow denoted as the medium M), and the medium roll 10 is configured by winding, on a roll core 101, the medium M having a predetermined width and being in an elongate ribbon shape.

The medium roll 10 is provided by being fitted onto a support shaft 2 of the printer 1, and in this state, the medium roll 10 is provided capable of rotating, together with the support shaft 2, about a center axis (pivotal axis X1) of the support shaft 2.

In the printer 1, the transport mechanism section 3 is located upstream of the printing section (not illustrated), and when the medium M is transported toward the printing section side by this transport mechanism section 3, the medium M drawn out from the medium roll 10 is pulled toward the transport mechanism section 3 (transport section 13) side in the medium roll 10, and is sequentially fed out from the medium roll 10.

The transport mechanism section 3 includes a driving roller 31 configured to rotate about a pivotal axis X7 by rotary driving power of an actuator (such as a motor) that is not illustrated, a pressing roller 32 provided rotatably about a pivotal axis X8 parallel to the pivotal axis X7, and a transport belt 33 strapped on the driving roller 31.

The pressing roller 32 is arranged with a space from the transport belt 33 strapped on the driving roller 31, which is smaller than a thickness of the medium M, and the medium M is configured to be held between an outer circumference of the pressing roller 32 and an outer circumference of the driving roller 31.

Due to this, in the transport mechanism section 3, when the driving roller 31 rotates by the rotary driving power of the actuator that is not illustrated, the medium M that is brought into pressure contact with the transport belt 33 by the pressing roller 32 is transported toward a downstream side of the transport mechanism section 3 (printing section side) together with the transport belt 33.

Further, the medium M wound on the medium roll 10 is configured to be fed out toward the transport section 13 in cooperation with the feeding of the medium M by the transport mechanism section 3.

As aforementioned, in the printer 1 according to the embodiment, the medium M woven by the material having the stretching property is used as a print target, and a curl Mc (curve) caused by the stretching property may be generated in this medium M being the print target on at least one side in a width direction.

Due to this, in the transport section 13, a first spreader roller 4 and a second spreader roller 5 are provided on a transport path of the medium M in the transport section 13, and these first spreader roller 4 and second spreader roller 5 straighten the curl Mc in the medium M before the medium M is supplied to the printing section.

Figure 2A:
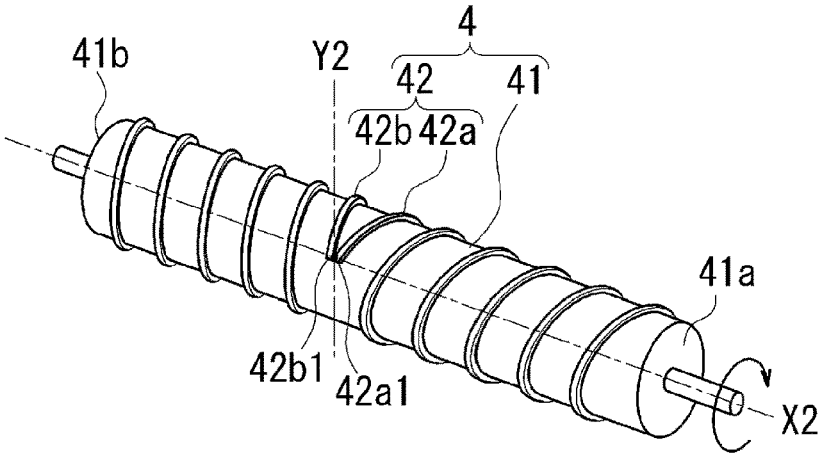
FIGS. 2A and 2B are perspective diagrams explaining a first spreader roller.
Figure 2B:
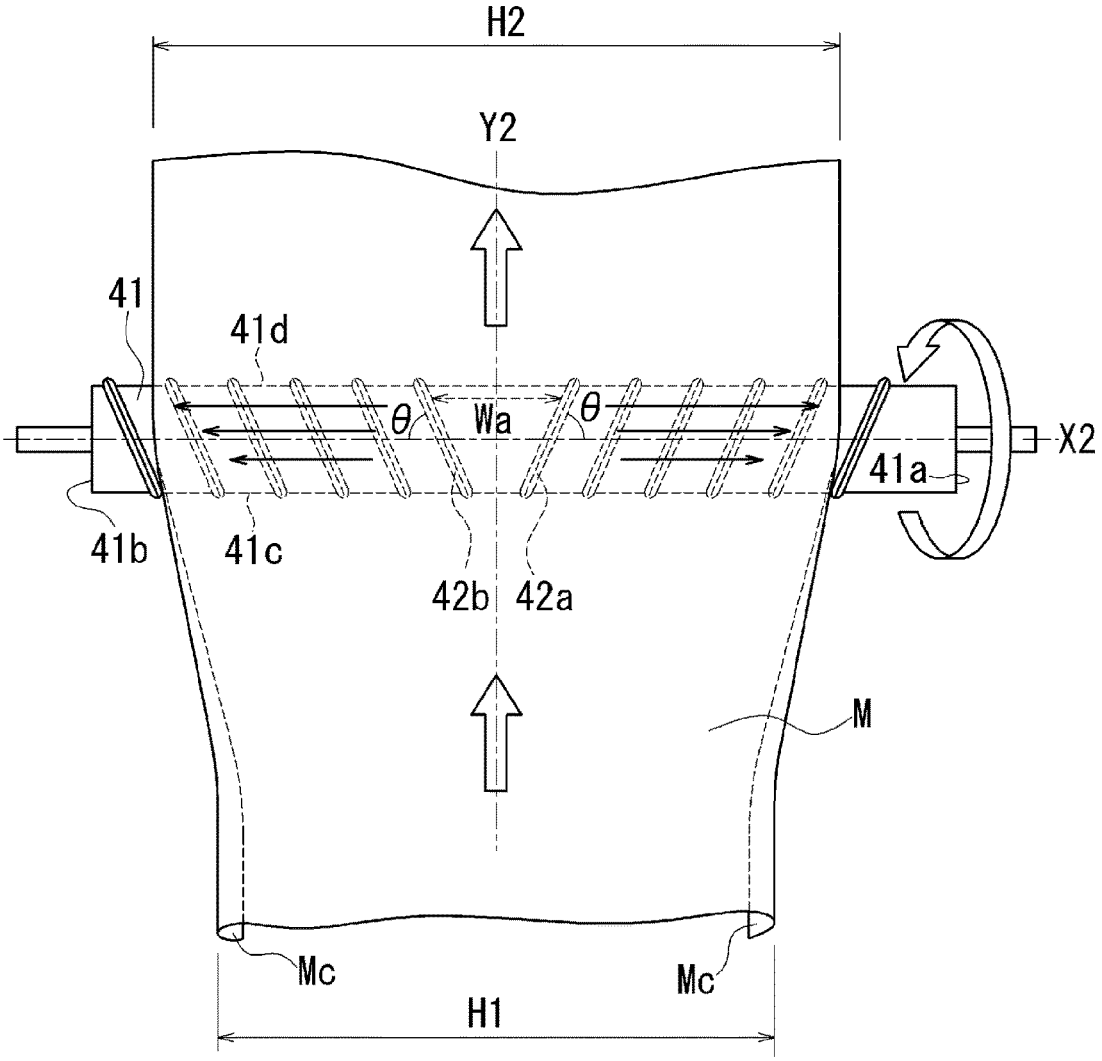

FIGS. 2A, 2B are diagrams explaining the first spreader roller 4, where FIG. 2A is a perspective view of the first spreader roller 4, and FIG. 2B is a plan view seeing the first spreader roller 4 along a radial direction of a pivotal axis X2, and is a diagram schematically showing how the medium M is spread out by the first spreader roller 4.

As illustrated in FIG. 2A, the first spreader roller 4 includes a columnar base portion 41, and a helical protrusion 42 is provided on an outer circumference of this base portion 41.

The helical protrusion 42 is formed by protruding along a radial direction of the pivotal axis X2 of the first spreader roller 4, and the helical protrusion 42 is configured of a helical protrusion 42*a* located on one side and a helical protrusion 42*b* located on the other side with a center line Y2 passing through a longitudinal center of the base portion 41 interposed therebetween.

These helical protrusions 42*a*, 42*b* extend on an outer circumference of the base portion 41 in helical shapes along a circumferential direction about the pivotal axis X2, and are provided at a positional relationship of being symmetric with the center line Y2 passing through the longitudinal center of the base portion 41 interposed therebetween.

As illustrated in FIG. 2B, in this embodiment, the helical protrusions 42*a*, 42*b* are provided such that a separating distance Wa between the helical protrusions 42*a*, 42*b* in a pivotal axis X2 direction becomes wider from one side 41*c* toward the other side 41*d* in a width direction of the base portion 41, in a plan view seeing along the radial direction of the pivotal axis X2, and the helical protrusions 42*a*, 42*b* are inclined by a predetermined angle θ relative to the pivotal axis X2 as seen along the radial direction of the pivotal axis X2.

Due to this, when the first spreader roller 4 rotates in a direction along which the medium M wound on its outer circumference is moved from the one side 41*c* toward the other side 41*d* of the base portion 41 in FIG. 2B, positions where the medium M is brought into pressure contact with the helical protrusions 42*a*, 42*b* shift toward respective end portions 41*a*, 41*b* of the base portion 41 (FIG. 2B, see arrows therein).

Directions along which the positions of pressure contact with the helical protrusions 42*a*, 42*b* shift are directions along which the width of the medium M is to be widened; therefore in this embodiment, the width of the medium M is spread from a width H1 before passing over the first spreader roller 4 to a width H2 after passing over the first spreader roller 4.

In the medium M fed out from the medium roll 10, at least one lateral side thereof in the width direction of the medium M may be curved toward one side in a thickness direction of the medium M, and a curl Mc may be generated at this portion.

Here, in the description hereinbelow, a surface on a side along a thickness direction of the medium M where the one lateral side thereof is curved may be denoted as a curled surface, and a surface on the other side may be denoted as a non-curled surface.

The first spreader roller 4 is configured to straighten the curl Mc generated in the medium M by winding (stretching) the curled surface of the medium M on an outer circumferential surface of the first spreader roller 4, after which the medium M is spread by being moved from one side (upstream side) 41*c* toward the other side (downstream side) 41*d* of the base portion 41 of the first spreader roller 4.

As illustrated in FIG. 1, in this embodiment, the first spreader roller 4 is provided rotatably about the pivotal axis X2 parallel to the pivotal axis X1 of the medium roll 10 on a vertical line VL which passes through the pivotal axis X1 of the medium roll 10.

Here, the curled surface of the medium M may be a back surface Mb that was located on an inner side on the medium roll 10 in some cases, and may be a front surface Ma that was located on an outer side thereon in other cases.

Figure 4:
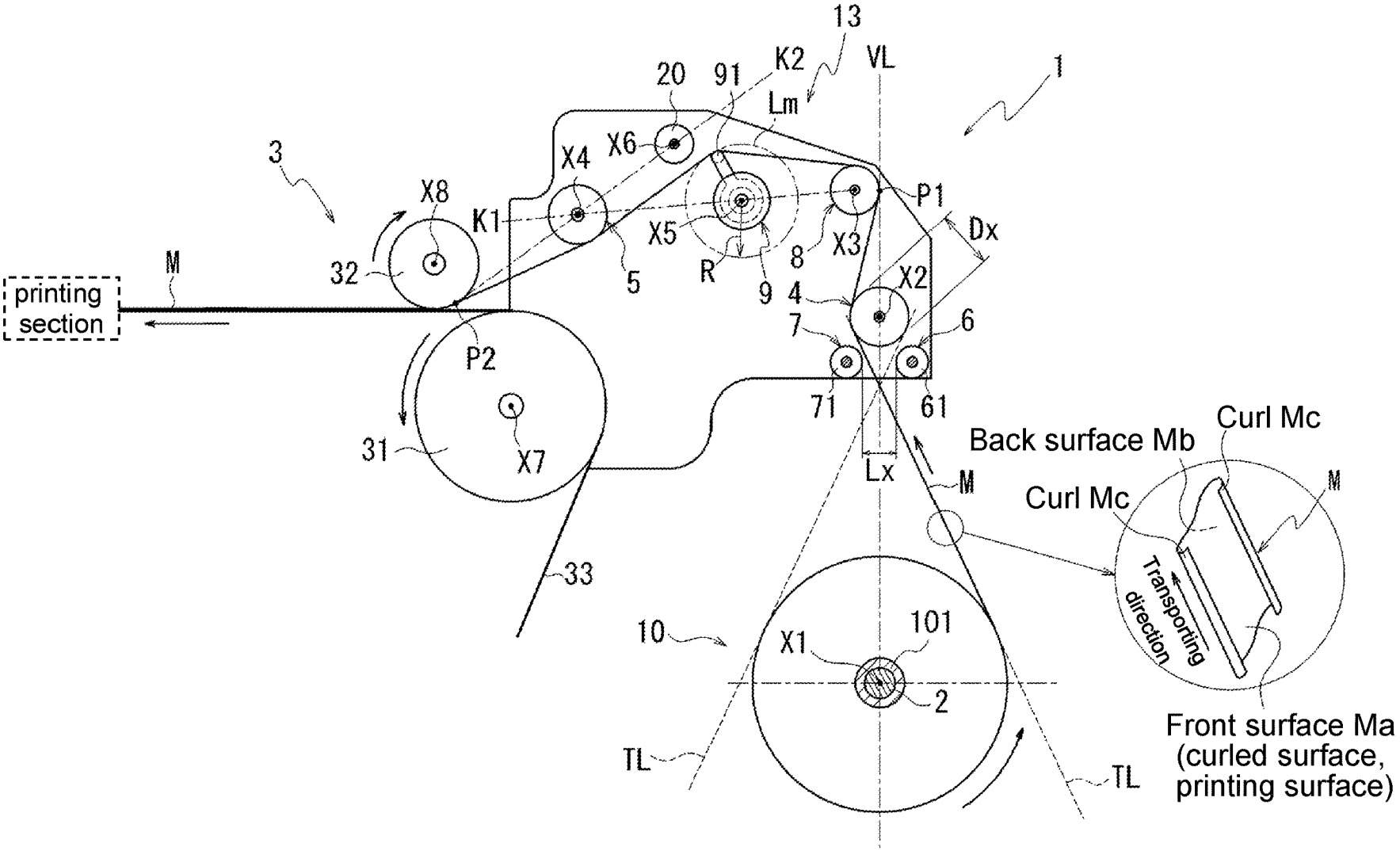
FIG. 4 is a diagram explaining an arrangement of a medium in the printer according to the embodiment.
Figure 5:
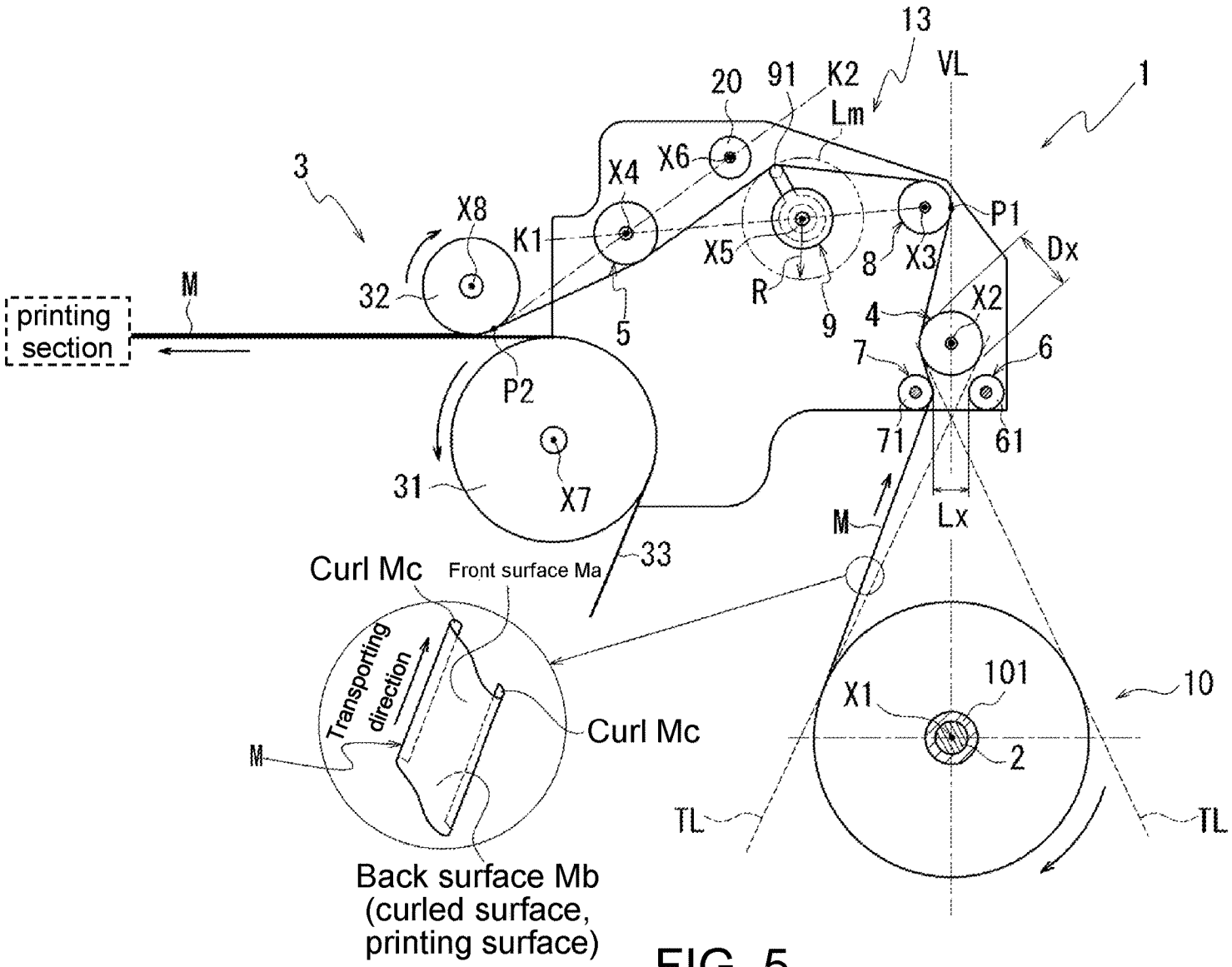
FIG. 5 is a diagram explaining the primary part on the transport section side in the printer according to the embodiment.
Figure 6:
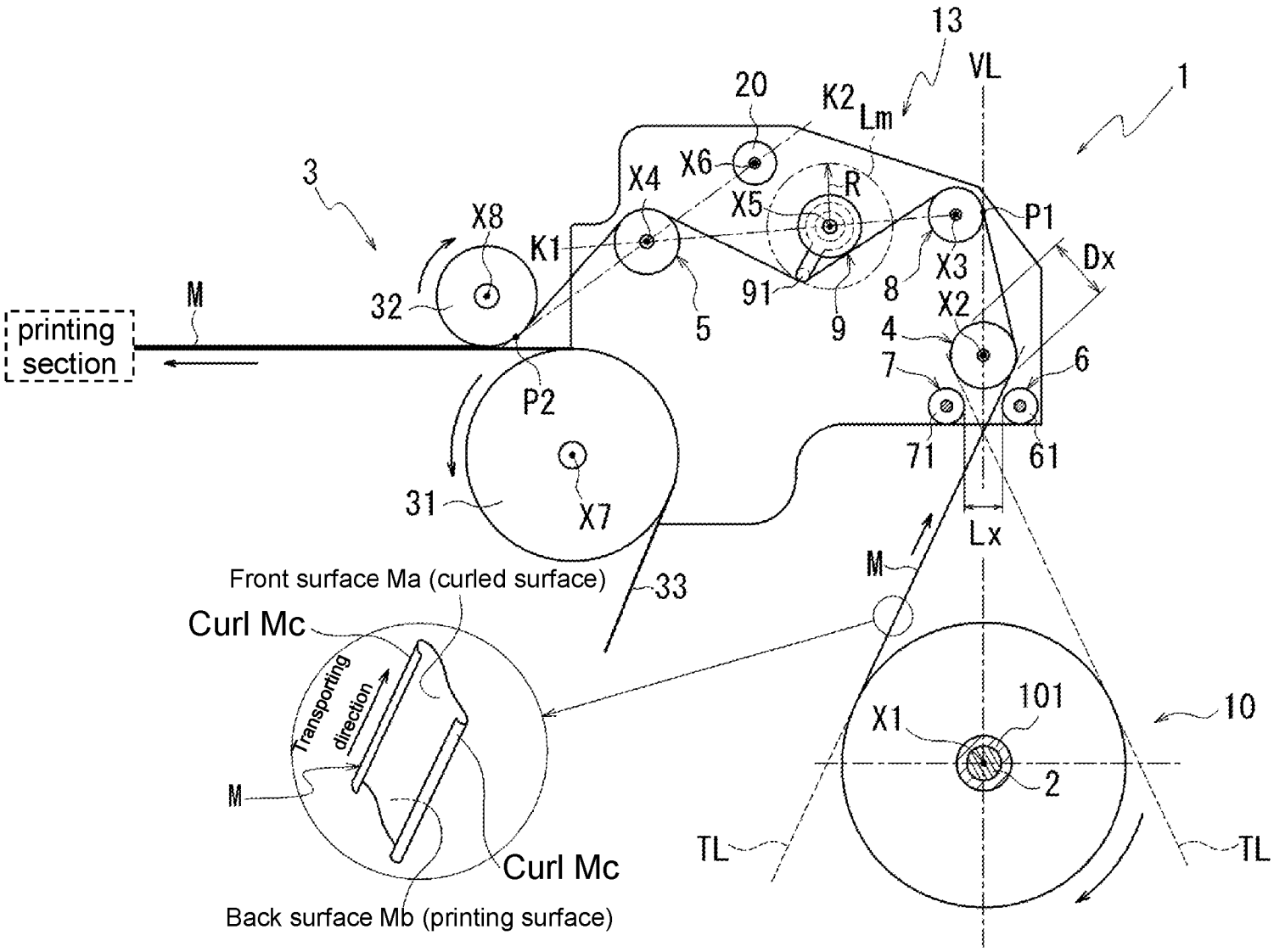
FIG. 6 is a diagram explaining the primary part on the transport section side in the printer according to an embodiment.

Further, in the printer 1, a winding direction of the medium M on the medium roll 10 set on the support shaft 2 may be in a counter-clockwise direction in some cases (see FIGS. 1 and 4), and in a clockwise direction in other cases (see FIGS. 5 and 6).

That is, in both of cases where the winding direction of the medium M on the medium roll 10 set on the support shaft 2 becomes the counter-clockwise direction and the clockwise direction, the curled surface may be the front surface Ma in some cases, and be the back surface Mb in other cases.

Specific cases are as follows: (A) the case where the medium roll 10 is set in an orientation by which the winding direction of the medium M in the roll core 101 is the counter-clockwise direction, and the back surface Mb is the curled surface (FIG. 1); (B) the case where the medium roll 10 is set in the orientation by which the winding direction of the medium M in the roll core 101 is the counter-clockwise direction, and the front surface Ma is the curled surface (FIG. 4); (C) the case where the medium roll 10 is set in an orientation by which the winding direction of the medium M in the roll core 101 is the clockwise direction, and the back surface Mb is the curled surface (FIG. 5); and (D) the case where the medium roll 10 is set in the orientation by which the winding direction of the medium M in the roll core 101 is the clockwise direction, and the front surface Ma is the curled surface (FIG. 6).

Due to this, in this embodiment, in order to enable the curled surface of the medium M to be wound on the outer circumference of the first spreader roller 4 even in cases of (A) and (C) among these (A) to (D) (cases where the curled surface of the medium M is on an inner diameter (back surface Mb) side of the medium roll 10), a pair of first direction-shifting bars 6, 7 are provided between the first spreader roller 4 and the medium roll 10 at a positional relationship of being symmetric with the vertical line VL interposed therebetween.

The pair of first direction-shifting bars 6, 7 are cylindrical members respectively supported by support shafts 61, 71 in a non-rotatable manner, and are configured to have the front surface Ma of the medium M wound thereon in the case where the curled surface of the medium M is the back surface Mb.

In this embodiment, the medium M is wound on the first direction-shifting bar 6, in the case where the medium roll 10 is set in the orientation by which the winding direction of the medium M on the roll core 101 is the counter-clockwise direction and also the back surface Mb is the curled surface (see the above (A): FIG. 1); and the medium M is wound on the first direction-shifting bar 7, in the case where medium roll 10 is set in the orientation by which the winding direction of the medium M on the roll core 101 is the clockwise direction and also the back surface Mb is the curled surface (see the above (C): FIG. 5).

As illustrated in FIG. 1, these first direction-shifting bars 6, 7 are arranged in a vertically-intersecting direction of the vertical line VL at positions farther away from the vertical line VL than tangential lines TL, TL connecting the outer circumference of the first spreader roller 4 and the outer circumference of the medium roll 10.

Due to this, the first direction-shifting bars 6, 7 are prevented from interfering with the medium M in the cases of directly winding the medium M on the first spreader roller 4 without intervening the first direction-shifting bars 6, 7 (see the case of above (B): FIG. 4, and the case of above (D): FIG. 6).

Moreover, a separating distance Lx between the first direction-shifting bars 6, 7 in the vertically-intersecting direction of the vertical line VL is set to a distance smaller than an outer diameter Dx of the first spreader roller 4.

Due to this, the medium M, the moving direction of which is changed by the first direction-shifting bars 6, 7, can surely be wound on the outer circumference of the first spreader roller 4 in the cases of winding the medium M on the first spreader roller 4 via the first direction-shifting bars 6, 7.

It should be noted that in this embodiment, the positions of the first direction-shifting bars 6, 7 are set such that an angle of approach of the medium M, the moving direction of which has been changed by the first direction-shifting bars 6, 7, to the first spreader roller 4 (contact angle between the outer circumferential surface of the first spreader roller 4 and the medium M) becomes an angle by which a contact area between the outer circumferential surface of the first spreader roller 4 and the medium M becomes a first predetermined area that is required for spreading out the medium M.

A second direction-shifting bar 8 for shifting a progressing direction of the medium M back toward a second spreader roller 5 side is provided above the first spreader roller 4.

The second direction-shifting bar 8 is a cylindrical member provided rotatably about a pivotal axis X3 parallel to the pivotal axis X1 of the medium roll 10, and the medium M is wound on an outer circumferential surface of the second direction-shifting bar 8.

In the embodiment, the medium M, which has been spread by the first spreader roller 4, is wound on the outer circumferential surface of the second direction-shifting bar 8, and a region of a predetermined area of the medium M is in pressure contact with the outer circumferential surface of the second direction-shifting bar 8.

Due to this, a shape of the medium M after the spreading is retained by the pressure contact force onto the second direction-shifting bar 8, and the shape of the medium M is prevented from returning to its pre-spreading shape with the large curl.

A surface roughening is given to the outer circumferential surface of the second direction-shifting bar 8 for preventing the medium M wound thereon from slipping. It should be noted that a cloth with a large sliding resistance may be wrapped around the outer circumferential surface of second direction-shifting bar 8.

In the embodiment, a position of the second direction-shifting bar 8 is determined such that, as seen along an axial direction of the pivotal axis X3, an initial contact point P1 of the medium M supplied from the first spreader roller 4 side with the outer circumferential surface of the second direction-shifting bar 8 is located on the vertical line VL passing through the pivotal axis X1 of the medium roll 10 and the pivotal axis X2 of the first spreader roller 4, or in a vicinity of the vertical line VL.

By arranging the second direction-shifting bar 8 as above, tension acting on the medium M (pressure contact force of the medium M onto the first spreader roller 4: stretching force) can be uniformized in both cases where the medium M is wound on the outer circumference of the first spreader roller 4 on a first direction-shifting bar 6 side (FIG. 1) and where the medium M is wound on the outer circumference of the first spreader roller 4 on a first direction-shifting bar 7 side (FIG. 5).

The second spreader roller 5 for straightening the curl Mc of the medium M is provided on a downstream side (printing section side) of the second direction-shifting bar 8 in the transporting direction of the medium M, and a tensioning bar 9 for adjusting the tension of the medium M supplied to the second spreader roller 5 is provided between this second spreader roller 5 and the second direction-shifting bar 8.

The second spreader roller 5 is provided rotatably about a pivotal axis X4 parallel to the pivotal axis X2 of the first spreader roller 4, and the curled surface of the medium M is wound on an outer circumferential surface of the second spreader roller 5.

It should be noted that since the second spreader roller 5 has an identical configuration as the aforementioned first spreader roller 4, a detailed description thereof will be herein omitted.

The tensioning bar 9 is provided rotatably about a pivotal axis X5 parallel to the pivotal axis X4 of the second spreader roller 5, and the pivotal axis X5 of the tensioning bar 9 is located on a line K1 connecting the pivotal axis X3 of the second direction-shifting bar 8 and the pivotal axis X4 of the second spreader roller 5.

The tensioning bar 9 includes a contacting portion 91 extending substantially parallel to the pivotal axis X5 along the pivotal axis X5 at a position separated by a predetermined distance R toward a radially outer side of the pivotal axis X5, and this contacting portion 91 is configured to be arranged at any position on a trajectory illustrated by a virtual line Lm in the drawing by rotation of the tensioning bar 9 about the pivotal axis X5.

In the embodiment, the tension of the medium M wound on the outer circumference of the second spreader roller 5 and the angle of approach of the medium M relative to the second spreader roller 5 are adjusted by bringing the contacting portion 91 into pressure contact with the non-curled surface of the medium M transported from the second direction-shifting bar 8 toward the second spreader roller 5.

Here, the angle of approach of the medium M relative to the second spreader roller 5 is set to an angle by which a contact area between the outer circumferential surface of the second spreader roller 5 and the medium M becomes a second predetermined area that is required for spreading out the medium M.

It should be noted that the second predetermined area may be the same as the first predetermined area in the case with the first spreader roller 4 as aforementioned.

As aforementioned, since the curled surface of the medium M has both cases where it is the front surface Ma (HG. 4 and FIG. 6) and it is the back surface Mb (FIG. 1 and FIG. 5), the contacting portion 91 of the tensioning bar 9 can be brought into contact with the non-curled surface in both the case where the curled surface is the front surface Ma and the case where the curled surface is the back surface Mb, by enabling the contacting portion 91 to be arranged at any desired position along the circumferential direction about the pivotal axis X5.

Further, by arranging the pivotal axis X5 of the tensioning bar 9 on the line K1, uniform tension can be applied to the medium M in both a case where the contacting portion 91 of the tensioning bar 9 makes contact with the medium M on one side of the line K1 (for example, on an upper side in the drawing) and a case where it makes contact with the medium M on the other side of the line K1 (for example, a lower side in the drawing).

In the transport section 13 of the medium M, a circumvention bar 20 is provided between the second spreader roller 5 and the second direction-shifting bar 8 on an outer side of a trajectory (see the virtual line Lm in the drawing) indicating a range within which the contacting portion 91 of the tensioning bar 9 can move.

Figure 7:
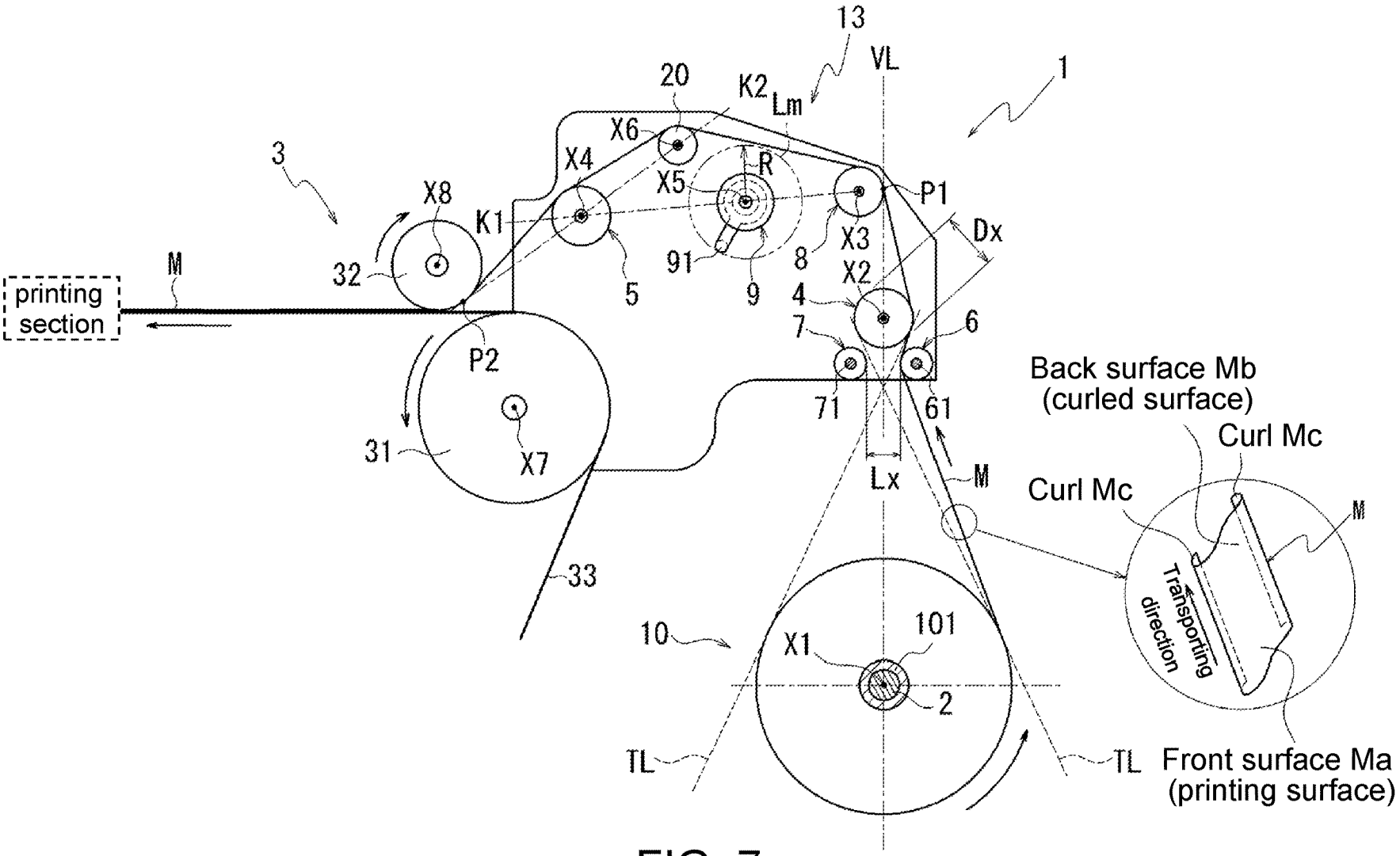
FIG. 7 is a diagram explaining the primary part on the transport section side in the printer according to an embodiment.

This circumvention bar 20 is a cylindrical member provided rotatably about a pivotal axis X6 parallel to the pivotal axis X4 of the second spreader roller 5, and the medium M is wound on its outer circumferential surface when the medium M is transported from the second direction-shifting bar 8 to the second spreader roller 5 while avoiding contact with the tensioning bar 9 (see FIG. 7).

The pivotal axis X6 of the circumvention bar 20 is located on a line K2 which connects the pivotal axis X4 of the second spreader roller 5 and an initial contact point P2 of the medium M supplied from the second spreader roller 5 with the outer circumferential surface of the pressing roller 32 as seen along an axial direction of the pivotal axis X4 in this embodiment.

By arranging the circumvention bar 20 as above, the tension applied to the medium M (pressure contact force of the medium M to the second pressure roller 5: stretching force) is uniformized in both the case where the front surface Ma of the medium M is wound on the outer circumference of the second spreader roller 5 and the case where the back surface Mb is wound thereon.

Here, a surface roughening is given to the outer circumferential surface of the circumvention bar 20 for preventing the medium M wound thereon from slipping. It should be noted that a cloth with a large sliding resistance may be wrapped around the outer circumferential surface of the circumvention bar 20.

Curl Straightening Method

Next, a curl straightening method carried out upon printing on the medium M using the printer 1 will be described, by exemplifying the case where the medium roll 10 is set in the orientation with which the winding direction of the medium M on the roll core 101 becomes the counter-clockwise direction, and the back surface Mb is the curled surface and the front surface Ma is the printing surface (non-curled surface) (see FIG. 1).

Figure 3:
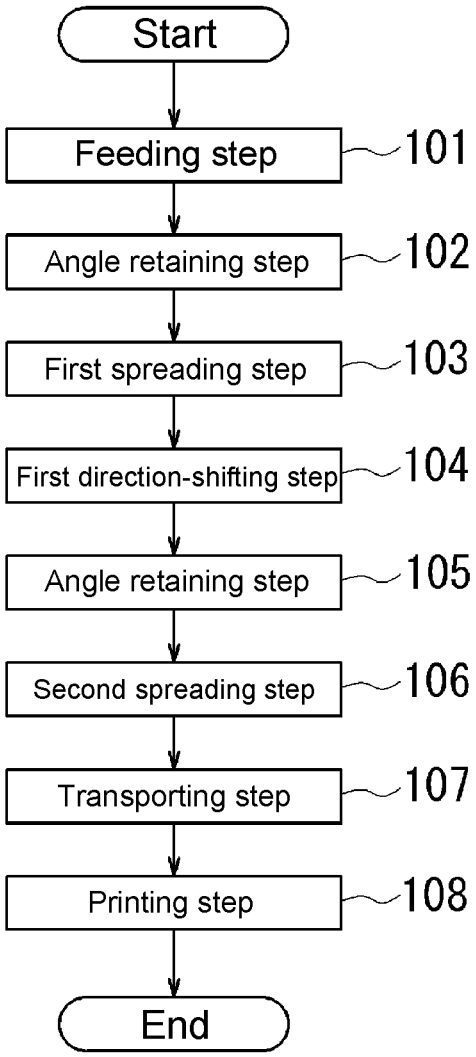
FIG. 3 is a flow chart of a printing method of the embodiment.

FIG. 3 is a flowchart explaining the curl straightening method carried out upon printing on the medium M using the printer 1.

Firstly, the medium M drawn out from the medium roll 10 is wound onto the first direction-shifting bar 6, the first spreader roller 4, the second direction-shifting bar 8, the tensioning bar 9, and the second spreader roller 5 in this order, and then it is set to pass through the transport mechanism section 3 and the printing section (not illustrated), and be wound up by a winding roller that is not illustrated (see FIG. 1).

When the driving roller 31 is rotated in this state, the medium M held between the transport belt 33 strapped on the driving roller 31 and the pressing roller 32 is transported to the printing section side together with the transport belt 33.

In so doing, the medium M wound on the medium roll 10 is sequentially fed out toward the transport section 13 side (first spreader roller 4 side) in cooperation with the transportation of the medium M by the transport mechanism section 3 (FIG. 3, step 101: feeding step).

Then, the transporting direction of the medium M fed out from the medium roll 10 is changed by the first direction-shifting bar 6 onto which the outer circumferential surface (front surface Ma) of the medium M is wound, and the medium M is then supplied to the first spreader roller 4 in the orientation by which the back surface Mb, which is the curled surface, makes contact with the outer circumference of the first spreader roller 4.

Here, in the printer 1, the position of the first direction-shifting bar 6 is determined so that the angle of approach of the medium M to the first spreader roller 4 is the angle by which contact area of the outer circumferential surface of the first spreader roller 4 and the medium M becomes the first predetermined area required for spreading out the medium M.

Due to this, the medium M that has passed over the first direction-shifting bar 6 is supplied to the first spreader roller 4 at the predetermined angle of approach (FIG. 3, step 102: angle retaining step).

As aforementioned, with the first spreader roller 4, the back surface Mb being the curled surface of the medium M is wound onto the outer circumferential surface of the first spreader roller 4.

Here, as illustrated in FIGS. 2A, 2B, the helical protrusions 42*a*, 42*b* are provided on the outer circumferential surface of the first spreader roller 4, and when rotation takes place in a direction along which the medium M wound onto the outer circumference is moved from the one side 41*c* to the other side 41*d* of the base portion 41 in FIG. 2B, the positions where the medium M is brought into pressure contact with the helical protrusions 42*a*, 42*b* shift toward the respective end portions 41*a*, 41*b* of the base portion 41 (FIG. 2B, see the arrows therein).

The directions along which the positions of pressure contact with the helical protrusions 42*a*, 42*b* shift are directions along which the width of the medium M is to be widened; therefore in this embodiment, the width of the medium M is spread from the width H1 before passing over the first spreader roller 4 to the width H2 after passing over the first spreader roller 4.

Due to this, the medium M having its curled surface wound on the outer circumference of the first spreader roller 4 is spread out, by which the region at least at the one lateral side in the width direction where the curl is generated is stretched, and the curl is thereby straightened (FIG. 3, step 103: first spreading step).

Next, the progressing direction of the medium M that has passed over the first spreader roller 4 is changed to the second spreader roller 5 side by the second direction-shifting bar 8 (FIG. 3, step 104: first direction-shifting step).

As aforementioned, the medium M, which has been spread by the first spreader roller 4, is wound on the outer circumferential surface of the second direction-shifting bar 8, and the region of the predetermined area of the medium M is in pressure contact with the outer circumferential surface of the second direction-shifting bar 8.

Due to this, a shape of the medium M after the spreading is retained by the pressure contact force onto the second direction-shifting bar 8, and the shape of the medium M is prevented from returning to its pre-spreading shape with the large curl.

Due to this, the medium M spread out by the first spreader roller 4 can be supplied to the second spreader roller 5 side while maintaining its state of being spread out and having the curl straightened by passing over the second direction-shifting bar 8.

The medium M on its way of being transported from the second direction-shifting bar 8 toward the second spreader roller 5 has the contacting portion 91 of the tensioning bar 9 contacting its non-curled surface, and the progressing direction of the transported medium M changes greatly toward the second spreader roller 5 side with the contacting point with the contacting portion 91 as a boundary.

Due to this, in the medium M, the tension required for winding the medium M onto the second spreader roller 5 is generated by having the contacting portion 91 in contact with the non-curled surface.

Moreover, in the printer 1, the angle of approach of the medium M relative to the second spreader roller 5 is determined according to an angular position of the contacting portion 91 of the tensioning bar 9 about the pivotal axis X5.

In this embodiment, the contacting portion 91 of the tensioning bar 9 is arranged at a position to enable the angle of approach of the medium M to the second spreader roller 5 to be at the angle by which the contact area of the outer circumference of the second spreader roller 5 and the medium M becomes the second predetermined area required for spreading the medium M upon printing using the printer 1.

Thus, the angle of approach of the medium M to the second spreader roller 5 is retained by the contacting portion 91 at the angle by which the contact area of the outer circumference of the second spreader roller 5 and the medium M becomes the second predetermined area required for spreading the medium M (FIG. 3, step 105: angle retaining step).

The medium M having passed over the contacting portion 91 is supplied to the second spreader roller 5 in the orientation by which its back surface Mb, being the curled surface, contacts with the outer circumference of the second spreader roller 5, so the medium M passes over the second spreader roller 5 in the state of being brought into pressure contact with the outer circumference of the second spreader roller 5.

Due to this, the medium M is spread out upon passing over the second spreader roller 5, by which the region at least at the one lateral side in the width direction where the curl is generated is stretched, and the curl is thereby straightened (FIG. 3, step 106: second spreading step).

Then, upon arriving at the transport mechanism section 3, the medium M that has been spread out by the second spreader roller 5 is brought into pressure contact with the transport belt 33 by the pressing roller 32, after which it is transported together with the transport belt 33 to the downstream side (printing section side) of the transport mechanism section 3 (FIG. 3, step 107: transporting step).

At this occasion, the medium M, the curl of which has further been straightened by being spread out by the second spreader roller 5, is brought into pressure contact with the transport belt 33 by the pressing force applied from the pressing roller 32.

At this occasion, the force which brings the medium M into pressure contact with the transport belt 33 (pressure contact force) exhibits a function of retaining the post-spreading shape of the medium M, so the shape of the medium M is prevented from returning to its shape before being spread out by the second spreader roller 5.

Due to this, the medium M, the curl of which has further been straightened by being spread out by the second spreader roller 5, is supplied to the printing section, and the printing on the printing surface (front surface Ma) of the medium M is thereby performed (FIG. 3, step 108: printing step).

Here, in this embodiment, the explanation of the transport path of the medium M drawn out from the medium roll 10 in the printer 1 is given by exemplifying (A) the case of having set the medium roll 10 in the orientation by which the winding direction of the medium M on the roll core 101 becomes the counter-clockwise direction, and the back surface Mb is the curled surface (see FIG. 1).

With the printer 1 of this embodiment, the curl of the medium M can suitably be straightened not only for the case (A), but also for any of (B) the case where the medium roll 10 is set in the orientation by which the winding direction of the medium M in the roll core 101 is in the counter-clockwise direction, and the front surface Ma is the curled surface (see FIG. 4); (C) the case where the medium roll 10 is set in an orientation by which the winding direction of the medium M in the roll core 101 is in the clockwise direction, and the back surface Mb is the curled surface (see FIG. 5); and (D) the case where the medium roll 10 is set in the orientation by which the winding direction of the medium M in the roll core 101 is in the clockwise direction, and the front surface Ma is the curled surface (see FIG. 6).

Thus, hereinbelow, the arrangement of the medium M on the transport path will be described for the aforementioned cases (B) to (D).

FIG. 4 is a diagram explaining the arrangement of the medium M in the printer 1 for the case of (B) where the medium roll 10 is set in the orientation by which the winding direction of the medium M in the roll core 101 is in the counter-clockwise direction, and the front surface Ma is the curled surface.

As illustrated in FIG. 4, in the case of (B), the medium roll 10 is set in the orientation by which the curled surface (front surface Ma) of the fed-out medium M can directly be wound on the outer circumference of the first spreader roller 4 without intervening the first direction-shifting bars 6, 7.

Due to this, the medium M drawn out from the medium roll 10 in the printer 1 is wound on the first spreader roller 4, the second direction-shifting bar 8, the tensioning bar 9, and the second spreader roller 5 in this order.

In this case as well, when the medium M passes over the first spreader roller 4 and the second spreader roller 5, it is spread out in the state of having the front surface Ma, being its curled surface, in pressure contact with the outer circumferences of the first spreader roller 4 and the second spreader roller 5 so that the region where the curl is generated is stretched, and the curl is thereby straightened.

FIG. 5 is a diagram explaining the arrangement of the medium M in the printer 1 for the case of (C) where the medium roll 10 is set in the orientation by which the winding direction of the medium M in the roll core 101 is in the clockwise direction, and the back surface Mb is the curled surface.

As illustrated in FIG. 5, in the case of (C), the medium roll 10 is set in the orientation by which the curled surface (back surface Mb) can be wound on the outer circumference of the first spreader roller 4 after having changed the transporting direction of the fed-out medium M by the first direction-shifting bar 7.

Due to this, in the printer 1, the medium M is wound on the first direction-shifting bar 7, the first spreader roller 4, the second direction-shifting bar 8, the tensioning bar 9, and the second spreader roller 5 in this order.

In this case as well, when the medium M passes over the first spreader roller 4 and the second spreader roller 5, it is spread out in the state of having the back surface Mb, being its curled surface, in pressure contact with the outer circumferences of the first spreader roller 4 and the second spreader roller 5 so that the region where the curl is generated is stretched, and the curl is thereby straightened.

FIG. 6 is a diagram explaining the arrangement of the medium M in the printer 1 for the case of (D) where the medium roll 10 is set in the orientation by which the winding direction of the medium M in the roll core 101 is in the clockwise direction, and the front surface Ma is the curled surface.

As illustrated in FIG. 6, in the case of (D), the medium roll 10 is set in the orientation by which the curled surface (front surface Ma) of the fed-out medium M can directly be wound on the outer circumference of the first spreader roller 4 without intervening the first direction-shifting bars 6, 7.

Due to this, the medium M drawn out from the medium roll 10 in the printer 1 is wound on the first spreader roller 4, the second direction-shifting bar 8, the tensioning bar 9, and the second spreader roller 5 in this order.

In this case as well, when the medium M passes over the first spreader roller 4 and the second spreader roller 5, it is spread out in the state of having the front surface Ma, being its curled surface, in pressure contact with the outer circumferences of the first spreader roller 4 and the second spreader roller 5 so that the region where the curl is generated is stretched, and the curl is thereby straightened.

As above, in the printer 1 according to the embodiment, the spreading of the medium M can be performed in the state of having the surface of the medium M on which the curl MC is generated (curled surface) wound on the outer circumferences of the first spreader roller 4 and the second spreader roller 5 in any of the aforementioned cases (A) to (D).

Due to this, when the medium M passes over the first spreader roller 4 and the second spreader roller 5, the region of the medium M where the curl is generated can be spread out to straighten the curl.

In the printer 1 according to the embodiment, the support shaft 2 rotatably supporting the medium roll 10 corresponds to a feeding section of the disclosure, the first direction-shifting bars 6, 7 correspond to an angle retaining section (first angle retaining section and second angle retaining section) of the disclosure, and the second direction-shifting bar 8 corresponds to a switching section of the disclosure.

As above, the embodiment provides a curl straightening method applied upon printing on a spread medium M in a printing step, the method being provided with: (1) a first spreading step (step 103) of spreading the medium M fed out from a medium roll 10 between a feeding step (step 101) of feeding the medium M from the medium roll 10 in which the medium M made of a textile fabric and having a predetermined width is wound on a roll core 101 and the printing step (step 108) of printing on the medium M fed out from the medium roll 10. In the first spreading step, spreading of the medium M is performed in a state where the medium M fed out from the medium roll 10 is stretched on an outer circumference of a first spreader roller 4 rotating about a pivotal axis X2 (first pivotal axis) parallel to a pivotal axis X1 (center axis) of the medium roll 10, and the medium M has its surface side with a curl Mc (front surface Ma or back surface Mb) stretched on the outer circumference of the first spreader roller 4.

By configuring as above, in the first spreading step, the spreading of the medium M is performed in the state where the surface of the medium M on the curled side (curled surface) is wound (stretched) on the outer circumference of the first spreader roller 4, so the curled region of the medium M can sufficiently be spread out to appropriately straighten the curl.

(2) A medium roll 10 supported rotatably on a support shaft 2, with a configuration including: a feeding section configured to feed a medium M from a medium roll 10 in which the medium M made of a textile fabric and having a predetermined width is wound on a roll core 101; a printing section (not illustrated) configured to print on the medium M fed out from the medium roll 10; a first spreader roller 4 provided on a transport path of the medium M (transport section 13) between the feeding section and the printing section, the first spreader roller being configured to spread the medium M stretched on its outer circumference while rotating about a pivotal axis X2 (first pivotal axis) parallel to a pivotal axis X1 (center axis) of the medium roll 10; and an angle retaining section (first direction-shifting bars 6, 7) configured to retain an angle of approach of the medium M onto the outer circumference of the first spreader roller 4 as seen along an axial direction of the pivotal axis X2 at a first predetermined angle. On the first spreader roller 4, the medium M has a curled surface side stretched on the outer circumference of the first spreader roller 4, and the first predetermined angle is an angle by which a contact area of the outer circumference of the first spreader roller 4 and the medium M becomes a first predetermined area, which is required for spreading out the medium M.

By configuring as above, the angle of approach of the medium M to the outer circumference of the first spreader roller 4 is retained at the first predetermined angle which facilitates the contact area of the outer circumference of the first spreader roller 4 and the medium M to become the first predetermined area required for spreading out the medium M, so the medium M wound on the first spreader roller 4 can surely be spread out to straighten the curl.

Further, the curl can sufficiently be stretched by distinguishing the curled surface and the non-curled surface of the medium M and letting the curled surface to stretch on the outer circumference of the first spreader roller 4.

Here, in the case where the curled surface of the medium M wound on the medium roll 10 is the back surface Mb (surface of the medium roll 10 on the inner diameter-side), the angle of approach of the medium M fed from the medium roll 10 to the first spreader roller 4 as seen along the pivotal axis X2 becomes larger as compared to the case where the curled surface is the front surface Ma (surface of the medium roll 10 on the outer diameter-side).

In this case, since the contact area as seen along a radial direction of the medium M and the first spreader roller 4 becomes small, by which the spreading of the medium M is insufficiently performed, and there is a risk that the curl straightening is not sufficient.

In the case where the curl is generated at least on the back surface Mb, the contact area of the outer circumference of the first spreader roller 4 and the medium M can be ensured by supplying the medium to the first spreader roller 4 via the first direction-shifting bars 6, 7.

Further, the pivotal axis X2 is located on the vertical line VL passing through the pivotal axis X1 of the medium roll 10 as seen along the axial direction of the pivotal axis X2, and the first direction-shifting bars 6, 7 include the first direction-shifting bar 6 (first angle retaining section) and the first direction-shifting bar 7 (second angle retaining section) that are arranged symmetrically with the vertical line VL interposed in between.

By configuring as above, in both the case where the medium roll 10 is set in the orientation by which the winding direction of the medium M on the roll core 101 becomes the clockwise direction and the case where the medium roll 10 is set in the orientation by which the winding direction becomes the counter-clockwise direction, the angle of approach of the medium M to the outer circumference of the first spreader roller 4 can be set to a same angle in the event where the back surface Mb is the curled surface, and the tension acting on the medium M is uniformized. Thus, the transport control of the medium M in the transport section 13 can easily be performed.

Further, a configuration is provided which further includes: a second spreader roller 5 provided on the transport path of the medium M between the first spreader roller 4 and the printing section that is not illustrated, the second spreader roller 5 being configured to spread the medium M stretched on its outer circumference while rotating about a pivotal axis X4 (second pivotal axis) parallel to the pivotal axis X1 of the medium roll 10; and a tensioning bar 9 provided on the transport path of the medium M between the first spreader roller 4 and the second spreader roller 5, the tensioning bar 9 being configured to apply tension to the medium M. The tensioning bar 9 is provided rotatably about a pivotal axis X5 (third pivotal axis) parallel to the pivotal axis X4, and configured to be capable of displacing a contacting portion 91 with the medium M arranged on a radially outer side of the pivotal axis X5 along a circumferential direction about the pivotal axis X5; on the second spreader roller 5, the medium M has a curled surface side stretched on the outer circumference of the second spreader roller 5; the tensioning bar 9 brings the contacting portion 91 into contact with a non-curled surface side of the medium M to retain an angle of approach of the medium M onto the outer circumference of the second spreader roller 5 as seen along an axial direction of the pivotal axis X5 at a second predetermined angle; and the second predetermined angle is an angle by which a contact area of the outer circumference of the second spreader roller 5 and the medium M becomes a second predetermined area.

By configuring as above, in the transport section 13, the tensioning bar 9 for retaining the angle of approach of the medium M to the second spreader roller 5 at the second predetermined angle is provided between the first spreader roller 4 and the printing section that is not illustrated. Further, by allowing the contacting portion 91 of the tensioning bar 9 to be arranged at desired positions along the circumferential direction about the pivotal axis X5, the contacting portion 91 can be brought into contact with the non-curled surface in both cases where the curled surface is the front surface Ma and the back surface Mb.

Thus, in the transport section 13, the angle of approach of the medium M, which is fed from the first spreader roller 4, to the second spreader roller 5 can be adjusted to the predetermined angle, and the spreading of the medium M by the second spreader roller 5 can surely be performed.

Further, in the transport section 13, the second predetermined angle of the medium M to the second spreader roller 5 is set to the angle by which the contact area of the outer circumference of the second spreader roller 5 and the medium M becomes the second predetermined area, so the spreading of the medium M by the second spreader roller 5 can more surely be performed.

Moreover, by arranging the contacting portion 91 at a desired position by rotating the tensioning bar 9, the medium M can be applied with tension while switching the transporting direction of the medium.

A configuration is provided that further includes a second direction-shifting bar 8 (switching section) provided on the transport path of the medium M between the first spreader roller 4 and the tensioning bar 9, and configured to switch a transporting direction of the medium M. The second direction-shifting bar 8 is configured to be rotatable about a pivotal axis X3 (fourth pivotal axis) parallel to the pivotal axis X2, and provided so that a contact point P1 (contact position) of an outer circumference of the second direction-shifting bar 8 and the medium M is located on a vertical line VL or in a vicinity of the vertical line VL as seen along an axial direction of the pivotal axis X3.

By configuring as above, the medium M is wound on the second direction-shifting bar 8 provided between the first spreader roller 4 and the tensioning bar 9. Thus, the medium M in the state of having the curl Mc and wrinkles spread out by the first spreader roller 4 is brought into pressure contact with the second direction-shifting bar 8, by which the curl Mc and wrinkles spread out while being transported by the tensioning bar 9 can be suppressed from returning.

Further, since the contact point P1 of the outer circumference of the second direction-shifting bar 8 and the medium M and the vertical line VL passing through the pivotal axis X1 of the medium roll 10 form a substantially one straight line, the tension applied to the medium M (the pressure contact force of the medium M to the first spreader roller 4) can be uniformized in both the case where the medium M is wound on the outer circumference of the first spreader roller 4 on the first direction-shifting bar 6 side (FIG. 1) and the case where the medium M is wound on the outer circumference of the first spreader roller 4 on the first direction-shifting bar 7 side (FIG. 5). Thus, the transport control of the medium M in the transport section 13 can easily be performed.

The second direction-shifting bar 8 is arranged at the position avoiding interference with the contacting portion 91 of the tensioning bar 9 which displaces along the circumferential direction about the pivotal axis X5.

By configuring as above, the interference between the second direction-shifting bar 8 and the contacting portion 91 of the tensioning bar 9 is prevented, and the transportation of the medium M by the second direction-shifting bar 8 can surely be performed.

Further, a configuration is provided which further includes a circumvention bar 20 (guide bar) for guiding the medium M, the transporting direction of which has been switched by the second direction-shifting bar 8 (switching section), to the second spreader roller 5 by passing the medium through an outer side of a movable region of the contacting portion 91 of the tensioning bar 9 that displaces in a circumferential direction about a pivotal axis X5 (third pivotal axis).

Depending on types of the medium, when the tension by the tensioning bar 9 is applied to the medium, there is a case where stretching is performed beyond a plastically deformable region of the medium.

By configuring as above, the printer 1 winds the medium M on the circumvention bar 20 and therefore can guide the medium M to the second spreader roller 5 to avoid contact between the medium M and the contacting portion 91 and without applying the tension by the tensioning bar 9.

Further, the printer 1 can easily switch whether or not to circumvent the tensioning bar 9 by simply changing whether to wind the medium M fed from the second direction-shifting bar 8 on the tensioning bar 9 or on the circumvention bar 20 instead of the tensioning bar 9.

A configuration is provided, which further includes: a transport mechanism section 3 provided on the transport path of the medium M between the second spreader roller 5 and the printing section that is not illustrated. The transport mechanism section 3 includes: a driving roller 31 provided rotatably about a pivotal axis X7 (fifth pivotal axis); a transport belt 33 strapped on the driving roller 31 to be transported toward the printing section side along with rotation of the driving roller 31 about the pivotal axis X7; and a pressing roller 32 provided on an opposite side from the driving roller 31 with the transport belt 33 interposed in between, and provided rotatably about a pivotal axis X8 (sixth pivotal axis) parallel to the pivotal axis X7. The pressing roller 32 is arranged with a gap from the transport belt 33 strapped on the driving roller 31, the gap being smaller than a thickness of the medium M, and the medium M held between an outer circumference of the pressing roller 32 and an outer circumference of the transport belt 33 and brought into pressure contact with the transport belt 33 by the pressing roller 32 is transported to the printing section side together with the transport belt 33 transported by rotation of the driving roller 31.

By configuring as above, in the printer 1, the medium M held between the outer circumference of the pressing roller 32 and the outer circumference of the transport belt 33 is brought into pressure contact with the transport belt 33 by the pressing roller 32, so the medium M can surely be transported to the printing section side together with the transport belt 33, which is transported to the printing section side by the rotation of the driving roller 31.

Modified Example

Figure 8:
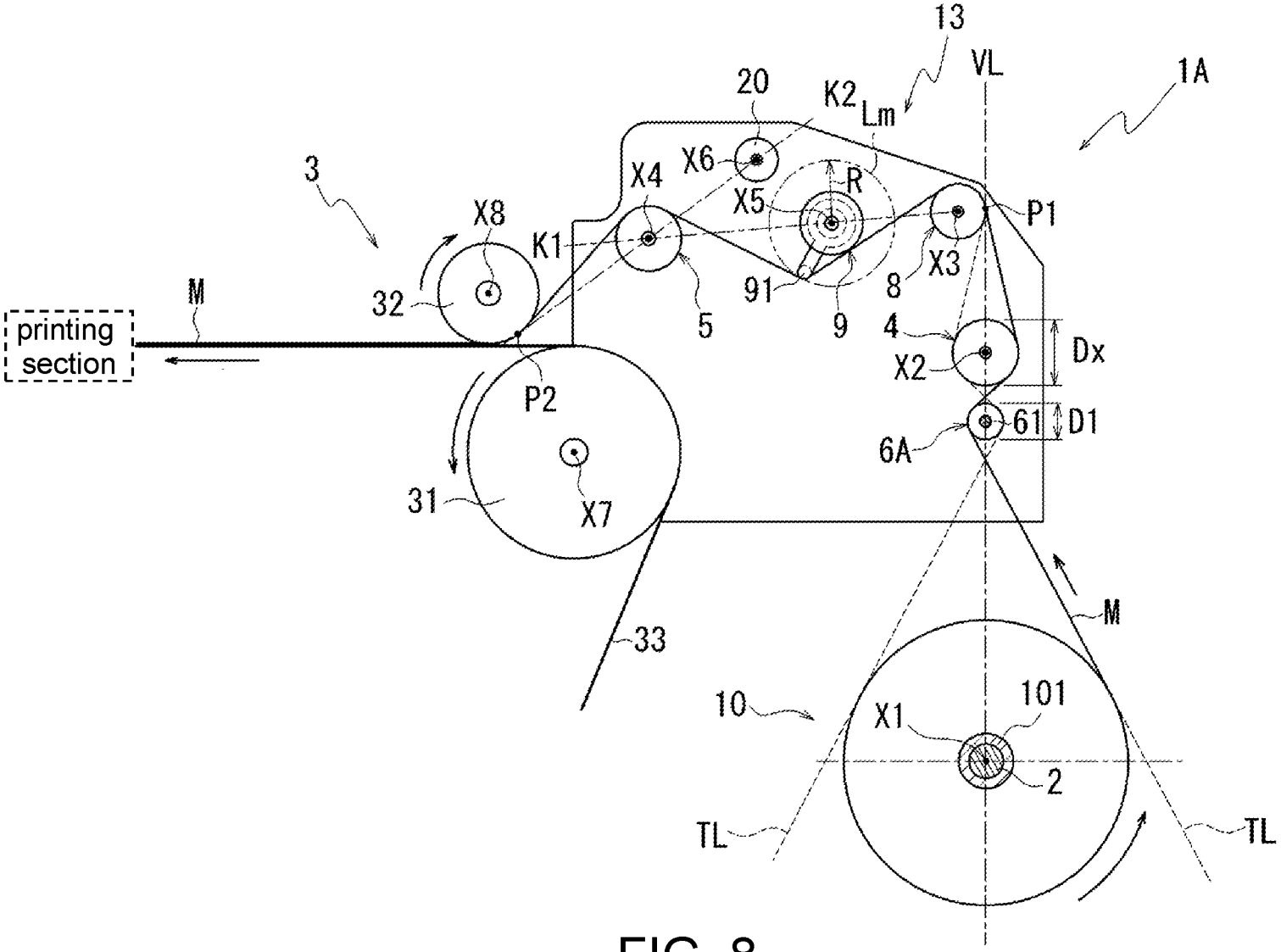
FIG. 8 is a diagram explaining a primary part on a transport section side in a printer according to a modified example.

FIG. 8 is a schematic diagram of a transport section 13 side of a printer 1A according to a modified example, and is a diagram for explaining an arrangement of the medium M on a transport path thereof.

In the aforementioned embodiment, the case of providing the two first direction-shifting bars 6, 7 at the positions symmetric relative to the vertical line VL passing through the pivotal axis X1 of the medium roll 10 as seen along the axial direction of the pivotal axis X2 between the medium roll 10 and the first spreader roller 4 has been exemplified; however, a single first direction-shifting bar 6A may be provided between the medium roll 10 and the first spreader roller 4.

As illustrated in FIG. 8, in the printer 1A, the first direction-shifting bar 6A (angle retaining section) is provided between the medium roll 10 and the first spreader roller 4.

As seen along the axial direction of the pivotal axis X1 of the medium roll 10, the first direction-shifting bar 6A (angle retaining section) is a cylindrical member supported by the support shaft 61 in a non-rotatable manner, and is arranged parallel to the pivotal axis X1 of the medium roll 10 on the vertical line VL.

An outer diameter D1 of the first direction-shifting bar 6A is set to an outer diameter smaller than the outer diameter Dx of the first spreader roller 4, and the medium M fed out from the medium roll 10 is wound onto an outer circumference of the first direction-shifting bar.

In the printer 1A, the medium M fed out from the medium roll 10 is supplied to the first spreader roller 4 via the first direction-shifting bar 6A, so the angle of approach of the medium M to the first spreader roller 4 can be retained at a suitable angle of approach.

In this embodiment, a position of the first direction-shifting bar 6A is determined so that an angle is achieved which causes the contact area between the outer circumferential surface of the first spreader roller 4 and the medium M to become the first predetermined area that is required for spreading out the medium M.

Further, since a pivotal axis of the first direction-shifting bar 6A is located on the vertical line VL passing through the pivotal axis X1 of the medium roll 10, a feed-out distance from the medium roll 10 becomes equalized regardless of the winding direction of the medium M on the roll core 101 (clockwise direction or counter-clockwise direction), and the tension acting on the medium M can be uniformized. Due to this, transport control of the medium M in the transport section 13 can easily be performed.

Further, since only one first direction-shifting bar 6A can be provided, a number of components configuring the transport section 13 can be reduced, which can achieve simplification of a transport section configuration, space reduction, and manufacturing cost reduction.

Further, a plurality of first direction-shifting bars 6A having different outer diameters D1 may be prepared, and adjustment of the tension acting on the medium M from the first direction-shifting bar 6A and adjustment of the angle of approach of the medium M to the first spreader roller 4 can easily be performed by simply replacing the first direction-shifting bar 6A depending on types of the medium M.

The present disclosure is not limited to the aforementioned embodiments, and encompasses various modifications and improvements within the scope of its technical concept.

What is claimed is:

1. A printer, comprising:

a medium roll for feeding a medium, wherein the medium made of a textile fabric and having a predetermined width is wound on a roll core;

a printing section, configured to print on the medium fed out from the medium roll;

a first spreader roller, provided on a transport path of the medium between the medium roll and the printing section, the first spreader roller being configured to spread the medium stretched on its outer circumference while rotating about a first pivotal axis parallel to a center axis of the medium roll; and an angle retaining section, configured to retain an angle of approach of the medium onto the outer circumference of the first spreader roller as seen along an axial direction of the first pivotal axis at a first predetermined angle, wherein on the first spreader roller, the medium has a curled surface side stretched on the outer circumference of the first spreader roller, and wherein the first predetermined angle is an angle by which a contact area of the outer circumference of the first spreader roller and the medium becomes a first predetermined area.

2. The printer according to claim 1, wherein the first pivotal axis is located on a vertical line passing through the center axis of the medium roll as seen along the axial direction of the first pivotal axis; and the angle retaining section is configured of a first retaining section and a second retaining section that are arranged symmetrically with the vertical line interposed in between.

3. The printer according to claim 1, wherein the first pivotal axis is located on a vertical line passing through the center axis of the medium roll as seen along the axial direction of the first pivotal axis; and the angle retaining section is a columnar member arranged on the vertical line and parallel to the center axis of the medium roll.

4. The printer according to claim 2, further comprising:

a second spreader roller, provided on the transport path of the medium between the first spreader roller and the printing section, the second spreader roller being configured to spread the medium stretched on its outer circumference while rotating about a second pivotal axis parallel to the center axis of the medium roll; and a tensioning bar, provided on the transport path of the medium between the first spreader roller and the second spreader roller, the tensioning bar being configured to apply tension to the medium, wherein the tensioning bar is provided rotatably about a third pivotal axis parallel to the second pivotal axis, and configured to be capable of displacing a contacting portion with the medium arranged on a radially outer side of the third pivotal axis along a circumferential direction about the third pivotal axis, wherein on the second spreader roller, the medium has a curled surface side stretched on the outer circumference of the second spreader roller, wherein the tensioning bar brings the contacting portion into contact with a non-curled surface side of the medium to retain an angle of approach of the medium onto the outer circumference of the second spreader roller as seen along an axial direction of the second pivotal axis at a second predetermined angle, and wherein the second predetermined angle is an angle by which a contact area of the outer circumference of the second spreader roller and the medium becomes a second predetermined area.

5. The printer according to claim 4, further comprising:

a switching section, provided on the transport path of the medium between the first spreader roller and the tensioning bar, and configured to switch a transporting direction of the medium, wherein the switching section is configured to be rotatable about a fourth pivotal axis parallel to the first pivotal axis, and provided so that a contact position of an outer circumference of the switching section and the medium is located on the vertical line or in a vicinity of the vertical line as seen along an axial direction of the fourth pivotal axis.

6. The printer according to claim 5, further comprising:

a guide bar for guiding the medium, the transporting direction of which has been switched by the switching section, to the second spreader roller by passing the medium through an outer side of a movable region of the contacting portion that displaces in a circumferential direction about the third pivotal axis.

7. The printer according to claim 4, further comprising:

a transport mechanism section, provided on the transport path of the medium between the second spreader roller and the printing section, wherein the transport mechanism section comprising:

a driving roller, provided rotatably about a fifth pivotal axis;

a transport belt, strapped on the driving roller to be transported toward a side of the printing section along with rotation of the driving roller about the fifth pivotal axis; and a pressing roller, provided on an opposite side from the driving roller with the transport belt interposed in between, and provided rotatably about a sixth pivotal axis parallel to the fifth pivotal axis, and wherein the pressing roller is arranged with a gap from the transport belt strapped on the driving roller, the gap being smaller than a thickness of the medium, and the medium held between an outer circumference of the pressing roller and an outer circumference of the transport belt and brought into pressure contact with the transport belt by the pressing roller is transported to the side of the printing section together with the transport belt transported by rotation of the driving roller.

8. The printer according to claim 3, further comprising:

a second spreader roller, provided on the transport path of the medium between the first spreader roller and the printing section, the second spreader roller being configured to spread the medium stretched on its outer circumference while rotating about a second pivotal axis parallel to the center axis of the medium roll; and a tensioning bar, provided on the transport path of the medium between the first spreader roller and the second spreader roller, the tensioning bar being configured to apply tension to the medium, wherein the tensioning bar is provided rotatably about a third pivotal axis parallel to the second pivotal axis, and configured to be capable of displacing a contacting portion with the medium arranged on a radially outer side of the third pivotal axis along a circumferential direction about the third pivotal axis, wherein on the second spreader roller, the medium has a curled surface side stretched on the outer circumference of the second spreader roller, wherein the tensioning bar brings the contacting portion into contact with a non-curled surface side of the medium to retain an angle of approach of the medium onto the outer circumference of the second spreader roller as seen along an axial direction of the second pivotal axis at a second predetermined angle, and wherein the second predetermined angle is an angle by which a contact area of the outer circumference of the second spreader roller and the medium becomes a second predetermined area.

9. The printer according to claim 8, further comprising:

a switching section, provided on the transport path of the medium between the first spreader roller and the tensioning bar, and configured to switch a transporting direction of the medium, wherein the switching section is configured to be rotatable about a fourth pivotal axis parallel to the first pivotal axis, and provided so that a contact position of an outer circumference of the switching section and the medium is located on the vertical line or in a vicinity of the vertical line as seen along an axial direction of the fourth pivotal axis.

10. The printer according to claim 9, further comprising:

a guide bar for guiding the medium, the transporting direction of which has been switched by the switching section, to the second spreader roller by passing the medium through an outer side of a movable region of the contacting portion that displaces in a circumferential direction about the third pivotal axis.

11. The printer according to claim 5, further comprising:

a transport mechanism section, provided on the transport path of the medium between the second spreader roller and the printing section, wherein the transport mechanism section comprising:

a driving roller, provided rotatably about a fifth pivotal axis;

a transport belt, strapped on the driving roller to be transported toward a side of the printing section along with rotation of the driving roller about the fifth pivotal axis; and a pressing roller, provided on an opposite side from the driving roller with the transport belt interposed in between, and provided rotatably about a sixth pivotal axis parallel to the fifth pivotal axis, and wherein the pressing roller is arranged with a gap from the transport belt strapped on the driving roller, the gap being smaller than a thickness of the medium, and the medium held between an outer circumference of the pressing roller and an outer circumference of the transport belt and brought into pressure contact with the transport belt by the pressing roller is transported to the side of the printing section together with the transport belt transported by rotation of the driving roller.

12. The printer according to claim 6, further comprising:

a transport mechanism section, provided on the transport path of the medium between the second spreader roller and the printing section, wherein the transport mechanism section comprising:

a driving roller, provided rotatably about a fifth pivotal axis;

a transport belt, strapped on the driving roller to be transported toward a side of the printing section along with rotation of the driving roller about the fifth pivotal axis; and a pressing roller, provided on an opposite side from the driving roller with the transport belt interposed in between, and provided rotatably about a sixth pivotal axis parallel to the fifth pivotal axis, and wherein the pressing roller is arranged with a gap from the transport belt strapped on the driving roller, the gap being smaller than a thickness of the medium, and the medium held between an outer circumference of the pressing roller and an outer circumference of the transport belt and brought into pressure contact with the transport belt by the pressing roller is transported to the side of the printing section together with the transport belt transported by rotation of the driving roller.

13. The printer according to claim 8, further comprising:

a transport mechanism section, provided on the transport path of the medium between the second spreader roller and the printing section, wherein the transport mechanism section comprising:

a driving roller, provided rotatably about a fifth pivotal axis;

a transport belt, strapped on the driving roller to be transported toward a side of the printing section along with rotation of the driving roller about the fifth pivotal axis; and a pressing roller, provided on an opposite side from the driving roller with the transport belt interposed in between, and provided rotatably about a sixth pivotal axis parallel to the fifth pivotal axis, and wherein the pressing roller is arranged with a gap from the transport belt strapped on the driving roller, the gap being smaller than a thickness of the medium, and the medium held between an outer circumference of the pressing roller and an outer circumference of the transport belt and brought into pressure contact with the transport belt by the pressing roller is transported to the side of the printing section together with the transport belt transported by rotation of the driving roller.

14. The printer according to claim 9, further comprising:

a transport mechanism section, provided on the transport path of the medium between the second spreader roller and the printing section, wherein the transport mechanism section comprising:

a driving roller, provided rotatably about a fifth pivotal axis;

a transport belt, strapped on the driving roller to be transported toward a side of the printing section along with rotation of the driving roller about the fifth pivotal axis; and a pressing roller, provided on an opposite side from the driving roller with the transport belt interposed in between, and provided rotatably about a sixth pivotal axis parallel to the fifth pivotal axis, and wherein the pressing roller is arranged with a gap from the transport belt strapped on the driving roller, the gap being smaller than a thickness of the medium, and the medium held between an outer circumference of the pressing roller and an outer circumference of the transport belt and brought into pressure contact with the transport belt by the pressing roller is transported to the side of the printing section together with the transport belt transported by rotation of the driving roller.

15. The printer according to claim 10, further comprising:

a transport mechanism section, provided on the transport path of the medium between the second spreader roller and the printing section, wherein the transport mechanism section comprising:

a driving roller, provided rotatably about a fifth pivotal axis;

a transport belt, strapped on the driving roller to be transported toward a side of the printing section along with rotation of the driving roller about the fifth pivotal axis; and a pressing roller, provided on an opposite side from the driving roller with the transport belt interposed in between, and provided rotatably about a sixth pivotal axis parallel to the fifth pivotal axis, and wherein the pressing roller is arranged with a gap from the transport belt strapped on the driving roller, the gap being smaller than a thickness of the medium, and the medium held between an outer circumference of the pressing roller and an outer circumference of the transport belt and brought into pressure contact with the transport belt by the pressing roller is transported to the side of the printing section together with the transport belt transported by rotation of the driving roller.

* * * * *